United States Patent [19]

Berg et al.

[11] Patent Number: 5,024,485

[45] Date of Patent: Jun. 18, 1991

[54] FRONT AND BACK ADJUSTABLE ROCKING SEAT SUPPORT ARRANGEMENT FOR SEAT HAVING RELATIVELY ADJUSTABLE SECTIONS

[76] Inventors: Joseph A. Berg, 5353 Topanga Canyon Blvd., Ste. 310, Woodland Hills, Calif. 91364; Loren W. Eames, 3718 Penn Mar Dr., El Monte, Calif. 91732

[21] Appl. No.: 548,267

[22] Filed: Jul. 5, 1990

[51] Int. Cl.[5] ..... A47C 1/02; A61G 15/00; B60N 2/00

[52] U.S. Cl. ..... 297/312; 297/313; 297/270

[58] Field of Search ..... 297/258, 312, 313, DIG. 7, 297/270, 302, 303; 108/119

[56] References Cited

U.S. PATENT DOCUMENTS

| | | | |
|---|---|---|---|
| 2,799,323 | 7/1957 | Berg . | |
| 3,080,195 | 1/1963 | Berg . | |
| 3,393,941 | 7/1968 | Grosfillex | 297/457 |
| 3,749,442 | 3/1973 | Berg . | |
| 4,047,755 | 4/1977 | Eames . | |

*Primary Examiner*—Peter R. Brown
*Assistant Examiner*—Milton Nelson, Jr.
*Attorney, Agent, or Firm*—Thomas I. Rozsa

[57] ABSTRACT

An improvement to the seat having relatively adjustable sections disclosed and claimed in U.S. Pat. No. 3,749,442 to restrict the movement of each separate seat section to movement only back and forth in a longitudinal rocking motion as opposed to universal movement, to thereby more effectively and efficiently assist in the comfort of the individual and adjustment of the seat to movements of the user without causing undue fatigue over time. The improvement includes a seat rocking member such as a cylindrical rod affixed to the lower portion of each seat half and a pair of spaced apart resilient receiving members for each seat half to movably and rotatably support a seat half on the base of the seat. The resilience of the receiving members permits the the seat rocking members to vertically move downward within the receiving members when a force such as the weight of a person pushes downward on the seat. The resilience of the receiving members further permits the seat rocking members to rock back and forth to thereby enable the user to independently rock back and forth in a front to back rocking arrangement on each seat half. An adjustable device limits the amount of front to back rocking which can be created.

8 Claims, 2 Drawing Sheets

FRONT AND BACK ADJUSTABLE ROCKING SEAT SUPPORT ARRANGEMENT FOR SEAT HAVING RELATIVELY ADJUSTABLE SECTIONS

BACKGROUND OF THE INVENTION

1. Field of the Invention

The present invention relates to the field of posture chairs which are various configurations for seating arrangements that are used to improve the posture of the individual by more efficiently supporting the weight of the individual who sits on the seat and adjusting the height of the seat sections to accommodate movement of the individual in the seat.

2. Description of the Prior Art

In general posture chairs and various seat configurations used as an integral part of the posture chair are known in the prior art. The present inventors are pioneers in having developed and patented several seating arrangement which help to provide greater comfort to individuals as they sit on a seat. The following patents have been issued to either inventor Joseph A. Berg individually or to co-inventors Joseph A. Berg and Loren W. Eames.

1. U.S. Pat. No. 2,799,323 issued to Joseph A. Berg on July 16, 1957 for "Self-Aligning Seat Construction".

2. U.S. Pat. No. 3,080,195 issued to Joseph A. Berg on Mar. 5, 1963 for "Self-Aligning Seating Construction".

3. U.S. Pat. No. 3,749,442 issued to Joseph A. Berg and Loren W. Eames on July 31, 1973 for "Seat Having Relatively Adjustable Sections".

4. U.S. Pat. No. 4,047,757 issued to Joseph A. Berg and Loren W. Eames on Sept. 13, 1977 for "Seating Structures With Flexible Backs".

In each of these patents, the object was to provide a seat construction which readily responds to or accommodates itself to the position of the body of the person occupying it. The object was to provide a seat which was self-aligning and which was so constructed that it allowed each side of the body of the occupant of the seat to move normally and independently of the other without restraint.

U.S. Pat. No. 2,799,323 provided an embodiment with two separate seat halves which were independently supported by coil springs.

U.S. Pat. No. 3,080,195 was an improvement on U.S. Pat. No. 2,799,323 and comprises a seat having two independent halves wherein the flexibility is provided through a resilient cushion under each of the seat sections.

U.S. Pat. No. 4,047,757 discloses a seating unit with a flexible seat back having an upper portion separated into two halves positioned to support a user's back at opposite sides of his spine.

U.S. Pat. No. 3,749,422 was a substantial mechanical improvement on the concept embodied in the prior two U.S. Pat. Nos. 2,799,323 and 3,080,195. In this patent, the invention involved a seat assembly having a base and two complementary seat elements supported thereon. Each seat element was able to move independently of the other seating element. Each seat pad was supported by a universal joint support which permitted each seat to move in any tilting orientation to accommodate different positions of the user's body. Each seat element had recesses or apertures offset rearwardly from the universal connections for receiving the ischial tuberosity bones of the user, and the back of the seat had a localized recess for partial reception of the lumbar portion of the user's backbone.

While the seat having adjustable sections as disclosed and claimed in U.S. Pat. No. 3,749,422 had many beneficial effects, one disadvantage which has been discovered through extensive use of the seat is that the universal support which provided free tilting movement of each seat section in any multiplicity of directions in fact provides too much free movement, thereby resulting in fatigue of the user after about an hour of use. Therefore, to correct this problem with the prior art seating arrangement disclosed in U.S. Pat. No. 3,749,422, it is necessary to cut down on the fully universal movement of the seat halves. Various other posture seating and seat arrangements are known in the prior art and the following patents are representative of such arrangements:

1. U.S. Pat. No. 1,990,661 issued to Middleton in 1935 for "Vehicle Seat".

2. U.S. Pat. No. 4,589,699 issued to Dungan in 1986 for "Sit-Kneel Chair".

3. U.S. Pat. No. 663,087 issued to Johnson in 1899 for "Chair".

4. German Offenlegungsschrift No. 35 13 985 Al. This was published in 1986.

The U.S. Pat. No. 1,990,661 to Middleton relates to a Vehicle Seat and is of interest as being disposed upon a plurality of spherical members 7. However the spherical members do not have a front and back locking and rocking arrangement.

U.S. Pat. No. 4,589,699 to Dungan is for the well known Sit-Kneel Chair and discloses a pivotally mounted seat 7. However, movement is dependant upon a single bolt 50 as opposed to the sphere and pin locking and rocking arrangement.

U.S. Pat. No. 633,087 issued to Johnson shows a chair including a seat F which may tilt forward and rearward. However, the mechanism which consists of an arc shape support block G is different than the present invention arrangement.

Finally, German Patent Publication issued in 1986 shows a tilting chair of interest with respect to the Ball 6. However, the tilting is performed by a spring 7 and not by a locking and rocking arrangement.

Therefore, there is a need for an improvement on the seat having relatively adjustable sections as disclosed in U.S. Pat. No. 3,749,442 which will permit each of the seat halves to move independently of each other but in a modified manner which will restrict the totally universal movement of the seat as disclosed in this prior art patent, to thereby enable individuals to have more effective use of the seating arrangement without too much free universal movement and thereby reduce the fatigue created by the prior art seat. There is also a further need for a pivotal support which provides these functions and also has some vertical play therein to enable the user to have the seat moved vertically downward when the user sits on it.

SUMMARY OF THE PRESENT INVENTION

The present invention is an improvement to the seat having relatively adjustable sections disclosed and claimed in U.S. Pat. No. 3,749,442 to restrict the movement of each separate seat section to movement only back and forth in a longitudinal rocking motion as opposed to universal movement, to thereby more effectively and efficiently assist in the comfort of the individual and adjustment of the seat to movements of the user without causing undue fatigue over time. The improvement comprises a seat rocking means such as a cylindrical rod affixed to the lower portion of each seat half and a pair of spaced apart resilient receiving means for each seat half to movably and rotatably support a seat half on the base of the seat. The resilience of the receiving means permits the seat rooking means to vertically move downward within the receiving means when a force such as the weight of a person pushes downward on the seat. The resilience of the receiving means further permits the seat rocking means to rock back and forth to thereby enable the user to independently rock back and forth in a front to back rocking arrangement on each seat half. The present invention further comprises an adjustable device to limit the amount of front to back rocking which can be created.

Therefore, it has been discovered, according to the present invention, that use of a resilient receiving means which permits both vertical and rotational movement combined with a rotational attaching means on the seat provides a joining assembly wherein each seat half can be rocked independently of the other half in the front to back rocking arrangement while at the same time prohibiting any lateral rocking and further prohibiting any other universal movement which therefore provides a seat which is an improvement over the seat described in U.S. Pat. No. 3,749,442 in that this steadier movement reduces the fatigue of the user when the user sits on the seat for a prolonged period of time.

It has further been discovered, according to the present invention, that the addition of an adjustable means which limits the amount of rocking about the seat rocking means enables the user to adjust the extent to which each separate half can rock about the pivot and therefore provides an individual adjustment to accommodate the desires of each individual user.

It is therefore an object of the present invention to provide an improvement in the seat disclosed in U.S. Pat. No. 3,749,442 wherein the improvement reduces the fatigue on the user when the seat is used for a prolonged period of time.

It is a further object of the present invention to provide a seat which can have the extent of the rocking of each seat half specifically adjusted to conform to the wishes of the individual users.

It is another object of the present invention to provide a seat assembly which is specifically designed to support the weight of a person with greater comfort than in conventional chairs, and to do so in a manner attaining automatic accommodation of the seat surfaces to slight movements of the user, with the seat divided into two half sections so that each side can individually move to accommodate the specific body of the user.

It is an additional object of the present invention to provide a seat which can adjust itself to the specific contours of the user through each half of the seat separately rocking back and forth about a pivot with the rocking only in the longitudinal direction, and in so doing helps to realign the body of the user through slight balancing of the hip and spine.

It is a further object of the present invention to make the seat portable so that it can be carried to any multiplicity of locations such as to sporting events, picnics, etc.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
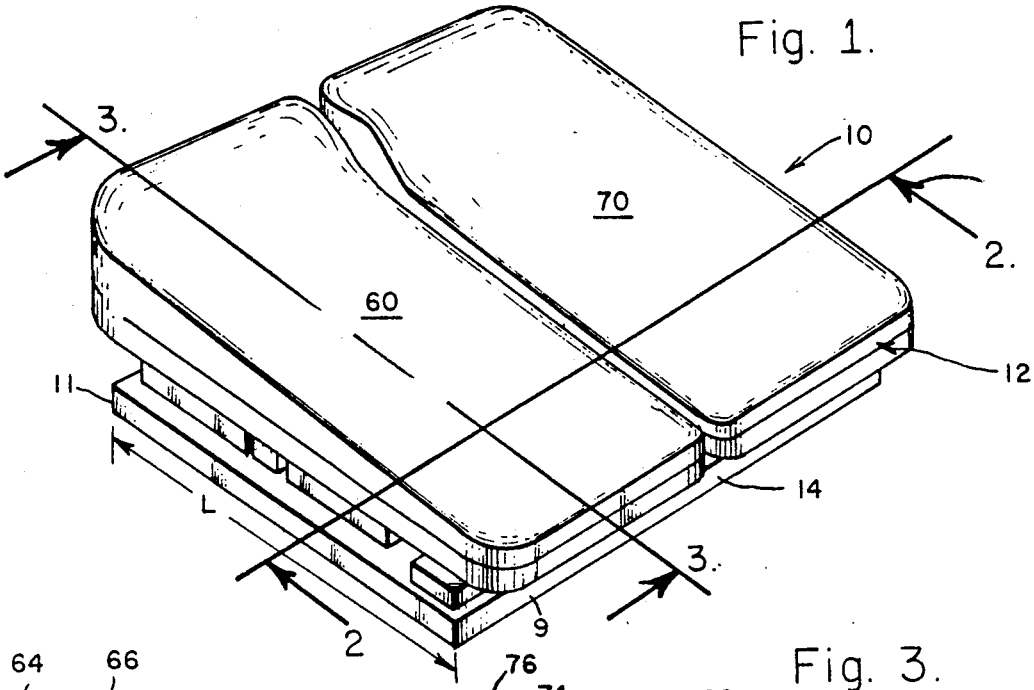
FIG. 1 is a perspective view of the present invention front and back rocking seat support arrangement for seat having relatively adjustable sections.
Figure 2:
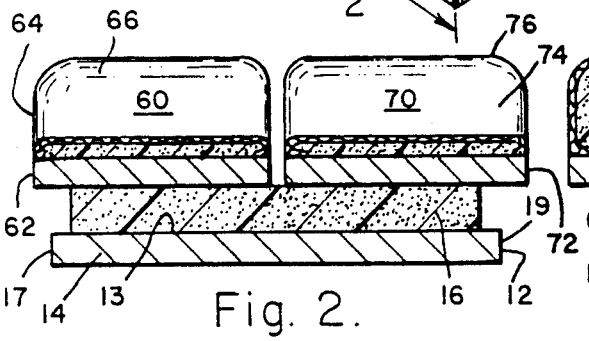
FIG. 2 is a cross-sectional view taken along line 2—2 of FIG. 1.
Figure 3:
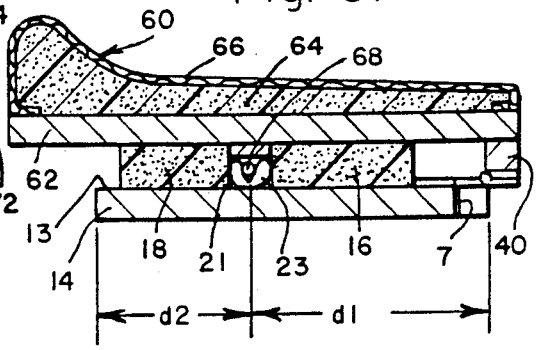
FIG. 3 is a cross-sectional view taken along line 3—3 of FIG. 1.
Figure 4:
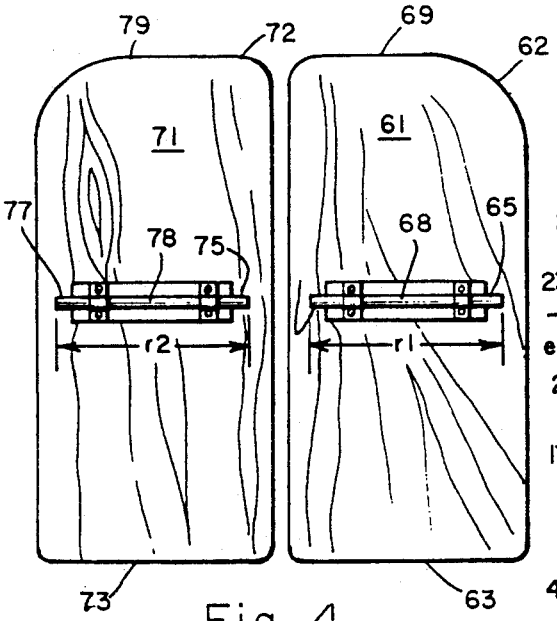
FIG. 4 is a plan view of the underside of each movable seat half, disclosing the seat rocking means attached to the underside of each seat half.
Figure 5:
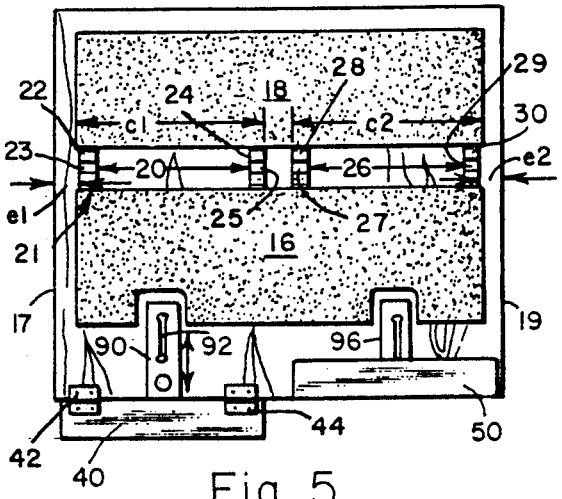
FIG. 5 is a plan view of the seat body, disclosing the cushioning members and the resilient receiving members for both movable seat halves.

Referring to FIGS. 1 through 5, there is shown at 10 the seat assembly which includes a seat body 12 to which two complementary seat cushion assemblies 60 and 70 are mounted for limited individual adjustable rocking movement. The seat body 12 further comprises a rigid base 14 and a pair of spaced apart resilient spacer members, a front spacer member 16 and a rear spacer member 18. Each spacer member is preferably made out of resilient cushioning material such as foam. Each spacer member 16 and 18 are affixed to the upper surface 13 of base 14. Set between the two spacer members are two pairs of resilient receiving means. First pair of resilient receiving means 20 comprises first resilient receiving means 22 and second resilient receiving means 24. Second pair of resilient receiving means 26 comprises third resilient receiving means 28 and fourth resilient receiving means 30. Each resilient receiving means comprises a resilient body member having two halves and separate by a transverse opening. For example, referring particularly to FIG. 3, resilient receiving means 22 comprises body member 21 which is divided by transverse opening 23. The body member 21 is made of resilient material such as spring steel so that its halves can spread apart when an object is inserted into the transverse opening 23. It will be appreciated that each such resilient receiving member, 22, 24, 28 and 30 is formed in the same way. In addition, as illustrated in FIG. 5, all four resilient receiving members are aligned with each other. By way of example, if the overall length "L" of base 14 is approximately 13 inches, in the preferred embodiment the distance "d1" from the centerline of the resilient receiving members to the front edge 9 of base 14 is approximately 7.75 inches while the distance d2 from the centerline of the resilient receiving members to the rear edge 11 of base 14 is approximately 5.25 inches. The maximum distance c1 between the first pair 20 of resilient members 22 and 24 is approximately 6⅜ inches. Similarly, the maximum distance c2 between the second pair 26 of resilient members 28 and 30 is approximately 6⅜ inches. The outermost resilient receiving members 22 and 30 are each set in from respective side edges 17 and 19 of base 14 by a distance of e1 and e2 respectively of approximately 0.75 inch. It will be appreciated that these dimensions are merely one illustrative embodiment and can include many other comparable sets of dimensions. For portability, base 14 may be made of molded plastic or comparable strong lightweight material.

The seat portion including the seat cover and foam cushioning material of each seat cushion assembly may also be contoured with various curves and other configurations as described in U.S. Pat. No. 3,749,442 to receive the ischial tuberosity bones of the user.

Rotatably affixed to the upper surface 13 of base 12 are a pair of rocker adjustment means 40 and 50. First rocker adjustment means 40 comprises a generally rectangular block which is affixed to the upper surface 13 of base 12 by hinge means 42 and 44 or comparable rotatable attaching means. First rocker adjustment means 40 is generally aligned with the first pair of resilient receiving means 20. Similarly, second rocker adjustment means 50 comprises a generally rectangular block which is affixed to the upper surface 13 of base 12 by comparable rotatable attaching means. Second rocker adjustment means 50 is generally aligned with the second pair of resilient receiving means 26.

The seat assembly comprises a pair of seat cushion assemblies 60 and 70 which extend over the seat body 12. First seat cushion assembly 60 comprises a generally flat cushion base 62, a foam cushioning material section 64 which is attached to cushion base 62 and cushion cover 66. Attached to the bottom surface 61 of cushion base 62 is a first seat rocking means 68 such as a cylindrical rod. The first seat rocking means 68 extends transversely to the longitudinal axis of cushion base 62 and is firmly affixed to lower surface 61. The length r1 of first seat rocking means 68 is sized to be at least as long at the maximum distance c1 between first pair 20 of resilient receiving means 22 and 24. First seat rocking means 68 is further dimensioned to fit within transverse openings in the resilient receiving means 22 and 24. The portion of first seat rocking means 68 adjacent its ends is received within a respective resilient receiving means. For example, the portion adjacent end 65 is received within transverse opening 23 of the resilient receiving means 22 and the portion adjacent end 67 is received within the transverse opening 25 of resilient receiving means 24. Similarly, second seat cushion assembly 70 comprises a generally flat cushion base 72, a foam cushioning material section 74 which is attached to cushion base 72 and cushion cover 76. Attached to the bottom surface 71 of cushion base 72 is a second seat rocking means 78 such as a cylindrical rod. The second seat rocking means 78 extends transversely to the longitudinal axis of cushion base 72 and is firmly affixed to lower surface 71. The length r2 of second seat rocking means 68 is sized to be at least as long at the maximum distance c2 between second pair 26 of resilient receiving means 28 and 30. Second seat rocking means 78 is further dimensioned to fit within transverse openings in the resilient receiving means 28 and 30. The portion of second seat rocking means 78 adjacent its ends is received within a respective resilient receiving means. For example, the portion adjacent end 75 is received within opening 27 of resilient receiving means 26 and the portion adjacent end 77 is received within the transverse opening 29 of resilient receiving means 30.

In operation, first seat cushion assembly 60 is placed onto the left half of seat body 14 such that seat rocking means 68 is received into the openings of resilient receiving means 22 and 24 in the manner previously described with the front end 63 of first seat cushion assembly 60 extending in the area of front end 9 of seat body 12 and the rear end 69 of first seat cushion assembly 60 extending in the area of rear end 11 of seat body 12. Similarly, second seat cushion assembly 70 is placed onto the right half of seat body 14 such that seat rocking means 78 is received into the openings of resilient receiving means 28 and 30 in the manner previously described with the front end 73 of second seat cushion assembly 70 extending in the area of front end 9 of seat body 12 and the rear end 79 of second seat cushion assembly 70 extending in the area of rear end 11 of seat body 12. When a downward force is exerted on the seat cushion assemblies such as a person sitting on them, then the resilient receiving means permits the inserted seat rocking means to move downwardly within their respective openings, thereby providing the user with a resilience comfort feeling to show that the seat has some give and play.

Figure 6:
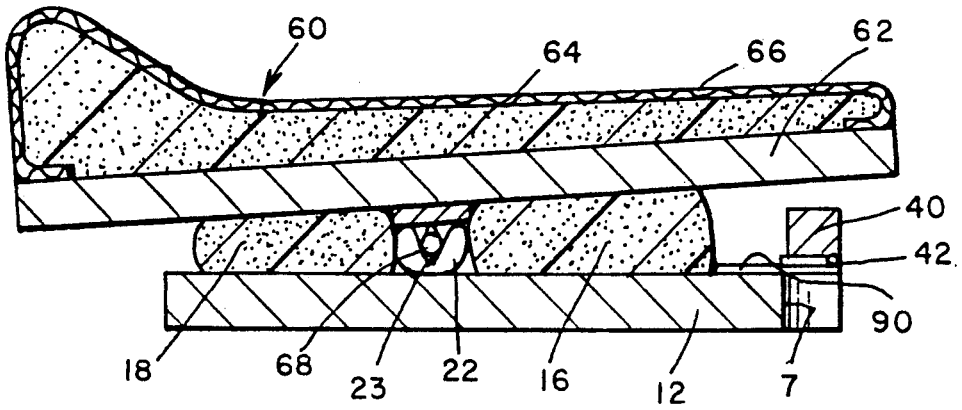
FIG. 6 is a cross-sectional view of the seat base, a rocking seat half, and the rocking adjustment means positioned in the half rock position.
Figure 7:
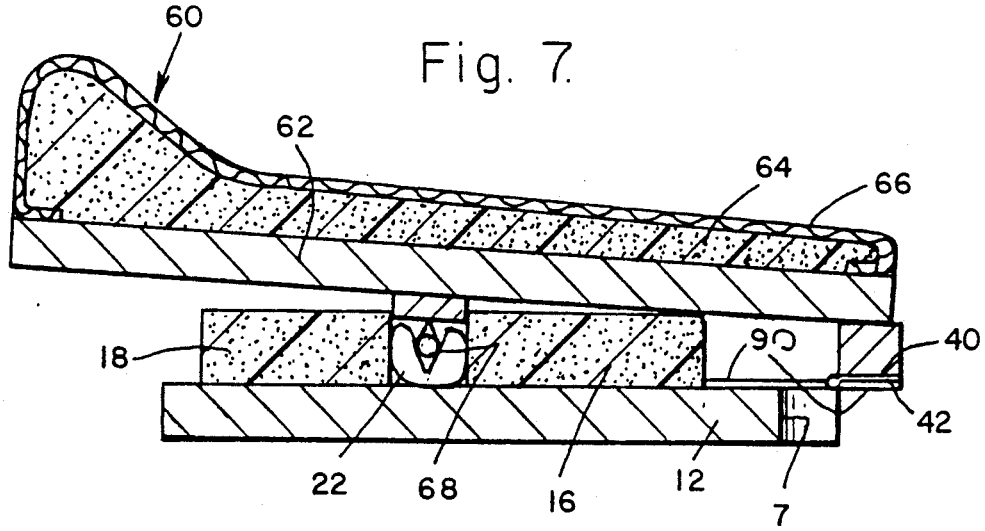
FIG. 7 is a cross-sectional view of the seat base, a rocking seat half, and the rocking adjustment means positioned in the locked non-rocking position.
Figure 8:
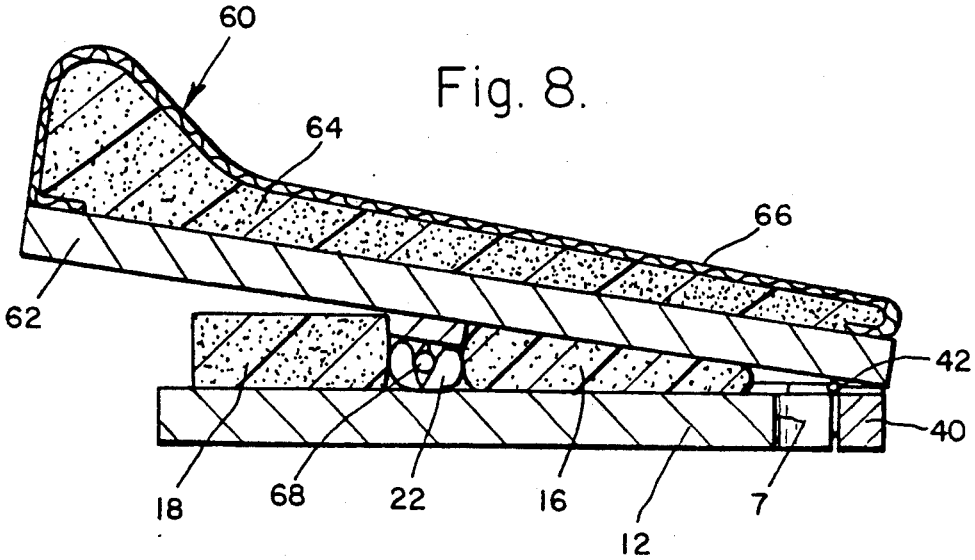
FIG. 8 is a cross-sectional view of the seat base, a rocking seat half, and the rocking adjustment means positioned in the maximum rock position.

Referring to FIGS. 6 through 8, each seat cushion assembly can rock front to back about its respective pivot formed at the intersection of its respective seat rocking means and the resilient receiving means into which it is inserted. The nature of the insertion prevents each seat cushion means from lateral rocking from side to side since each seat rocking means is inserted into the opening with a pair of resilient receiving means and is pressed into the opening adjacent the upper surface 13 of base 12, thereby preventing side to side or lateral rocking. Since first seat cushion means 60 is independent of second seat cushion means 70, each seat cushion means can rock front to back independently of the other, thereby enabling the user to completely position his body into the seat at any desired comfort level.

In addition, each seat cushion means can be adjusted to provide the desired amount of rocking by separate rocker adjustment means which limit the amount of forward rocking the portion of each seat cushion assembly can rock on its front end. The limitation adjacent its front end is important because that is the area where the individual's weight is concentrated against the seat assembly. FIGS. 6 through 8 illustrate the three rocker adjustment positions. As previously described, first rocker adjustment means 40 is hingeably attached to the upper surface 13 of base 14 by rotatable attachment means 42 and 44. Similarly, second rocker adjustment means 50 is hingeably attached to the upper surface 13 of base 14 by rotatable attachment means 52 and 54. In two of the adjustment positions, no additional device is required. Referring to FIG. 6, the half-rock or intermediate position of the rocker adjustment means is shown. In this case, the rocker adjustment means 40 is rotated about its rotatable attachment means such that one face of the rocker adjustment means 40 rests against the upper surface 13 of base 12. In this position, the lower surface 61 of seat cushion base 62 comes in contact with the surface of the rocker adjustment means 40 after a certain degree of front to back rocking has been achieved. Referring to FIG. 8, the maximum rock position of the rocker adjustment means is shown. In this case, the rocker adjustment means 40 is rotated in the clockwise direction about its rotatable attachment means by 180 degrees from the position illustrated in FIG. 6 such that one face of the rocker adjustment means 40 rests against the front face 9 of base 12. In this position, the rocker adjustment means 40 is essentially aligned with the base 14 and the lower surface 61 of seat cushion base 62 comes in contact with the surface of the rocker adjustment means 40 after the maximum degree of rock obtainable. In this position, the rocker adjustment means is essentially eliminated as a supplemental rocker blocking member since it is essentially aligned with the base 14 and therefore the seat rocket cushion 60 can rotate about its pivot for its maximum degree of rock the same as it no rocker adjustment means were present.

The other extreme position where the rocker seat assembly 60 is essentially prevented from any forward rocking is illustrated in FIG. 7. Referring to FIG. 5 as well as FIG. 7, slidably attached to the upper surface 13 of base 12 is a rocker adjustment means support member 90. Slidable rocker adjustment means support member 90 is mounted in base 12 by slidable attachment means 92 which by way of example may be a slot which accommodates a pair of screws which are embedded into base 12 but in a manner which is loose enough to permit slidable rocker adjustment means support member 90 to slide back and forth. In the preferred embodiment, the support member 90 is centrally mounted with respect to the width of a rocker seat assembly and the rocker adjustment means. In FIG. 5, the rocker adjustment means support member 90 is illustrated in fully retracted position such that it does not impact the rotation of rocker adjustment means 40. This is also the case in FIGS. 6 and 8. In the case of FIG. 7, the rocker adjustment means support member 90 is illustrated in fully opened position such that it extends beyond the front edge 9 of base 12. An opening 7 in base 12 enables a user to insert an object such as a rod or a finger to slide the support means 90 outwardly to its fully opened position. As illustrated in FIG. 7, with the support means in its fully opened position, the rocket adjustment means 40 is rotated in the clockwise direction by 90 degrees from the position illustrated in FIG. 6, such that it rests on the support means 90 and therefore extends generally perpendicular to the base 12. With the rocker adjustment means 90 extending generally perpendicular to the base, a surface of the rocker adjustment means 40 is aligned with the lower surface 61 of seat cushion body 62 when it is in the horizontal position and therefore the weight of the user on the seat prevents it from rocking forward. It will be appreciated that a second rocket adjustment means support means 96 is slidably positioned relative to second seat cushion assembly 70 and to second rocker adjustment means 50 (see FIG. 5) and operates in the same manner.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A seat comprising:

a. a body further comprising, (i) a base having an upper surface, a front, a rear and two longitudinal sides;

(ii) a pair of spaced apart resilient spacer members affixed transversely to the upper surface of said base and separated by a transverse gap which runs from one side of the base to the opposite side of the base;

(iii) two pairs of spaced apart resilient receiving means affixed to the upper surface of said base in said gap, each pair of resilient receiving means including a first resilient receiving means and a second resilient receiving means, with one of said first or second resilient receiving means positioned adjacent a side of the base and the other one of said first or second resilient receiving means positioned remote from the side;

b. a pair of longitudinally spaced apart seat cushion assemblies, each seat cushion assembly further comprising, (i) a lower surface;

(ii) a seat rocking means attached to the lower surface, the seat rocking means configured to be resiliently and rotatably retained by one of the said pairs of resilient receiving means so that the seat cushion assembly can longitudinally rock back and forth with the intersection of the pair of resilient receiving means and engaged seat rocking means serving as the pivot about which the seat cushion assembly rocks; and c. a pair of spaced apart rocker adjustment means attached to said base and aligned with a respective one of the seat cushion assemblies such that the rocker adjustment means can be positioned to adjust the amount of rocking arc obtainable by the seat cushion assemblies, where each rocker adjustment means further comprises a generally rectangular shaped block which is hingeably attached to the base such that the rocker adjustment means can be aligned in a multiplicity of separate positions including a first position wherein one side of the rocker adjustment means lies against the upper surface of the base, a second position wherein the rocker adjustment means lies parallel to and in the same plane as the base, and a third position wherein the rocker adjustment means is supported generally perpendicular to the base by a rocker support means slidably affixed to the base;

d. whereby each seat cushion assembly can be independently rocked back and forth longitudinally and can be individually adjusted to the desired amount of rocking, and the rocking on the base is cushioned by the pair of spacer members.

2. A seat in accordance with claim 1 wherein said base is made of plastic and the seat is portable.

3. A seat in accordance with claim 1 wherein said pair of spacer members are made of foam.

4. A seat in accordance with claim 1 wherein said pair of spaced apart rocker adjustment means are located adjacent to the front of said base.

5. A seat comprising:

a. a body further comprising, (i) a base having an upper surface, a front, a rear, a first side and a second side;

(ii) a pair of spaced apart resilient spacer members affixed to the upper surface of said base, including a front spacer member and a rear spacer member, separated by a gap which runs from one side of the base to the opposite side of the base;

(iii) a first pair of spaced apart resilient receiving means affixed to the upper surface of said base in said gap between the front spacer member and the rear spacer member, the first pair of resilient receiving means including a first resilient receiving means and a second resilient receiving means, with one of said first or second resilient receiving means positioned adjacent the first side of the base and the other one of said first or second resilient receiving means positioned remote from the first side;

(iv) a second pair of spaced apart resilient receiving means affixed to the upper surface of said base in said gap between the front spacer member and the rear spacer member and aligned with and spaced apart from the first pair of spaced apart resilient receiving means, the second pair of resilient receiving means including a first resilient receiving means and a second resilient receiving means, with one of said first or second resilient receiving means positioned adjacent the second side of the base and the other one of said first or second resilient receiving means positioned remote from the side;

(v) each resilient receiving means having a resilient body separated by a transverse gap extending into the body to divide it in half;

b. a first seat cushion assembly further comprising, (i) a cushion base having an upper surface and a lower surface;

(ii) cushioning material attached to the upper surface of the cushion base;

(iii) a cover protecting the cushioning material and the cushion base;

(iv) a seat rocking means attached to the lower surface of the cushion base, the seat rocking means configured to be engaged into the transverse opening in the bodies of said first pair of resilient receiving means and resiliently and rotatably retained within the bodies of the first and second resilient receiving means so that the seat cushion assembly can longitudinally rock back and forth with the intersection of the pair of resilient receiving means and engaged seat rocking means serving as the pivot about which the first seat cushion assembly rocks;

c. a second seat cushion assembly further comprising, (i) a cushion base having an upper surface and a lower surface;

(ii) cushioning material attached to the upper surface of the cushion base;

(iii) a cover protecting the cushioning material and the cushion base;

(iv) a seat rocking means attached to the lower surface of the cushion base, the seat rocking means configured to be engaged into the transverse opening in the bodies of said second pair of resilient receiving means and resiliently and rotatably retained within the bodies of the first and second resilient receiving means so that the seat cushion assembly can longitudinally rock back and forth with the intersection of the pair of resilient receiving means and engaged seat rocking means serving as the pivot about which the second seat cushion assembly rocks; and d. said first seat cushion assembly and said second seat cushion assembly spaced adjacent one another but separated by a distance to permit each seat cushion assembly to rock independently of each other from the front to the rear of the seat body;

e. a first rocker adjustment means located adjacent the front of said base and aligned with the first pair of resilient receiving means and first seat cushion assembly such that the first rocker adjustment means can be positioned to adjust the amount of rocking arc obtainable by the first seat cushion assembly, where the first rocker adjustment means further comprises a generally rectangular shaped block which is hingeably attached to the base such that the rocker adjustment means can be aligned in three separate positions, a first position wherein one side of the rocker adjustment means lies against the upper surface of the base, a second position wherein the rocker adjustment means lies parallel to and in the same plane as the base, and a third position wherein the rocker adjustment means is supported generally perpendicular to the base by a first rocker support means slidably affixed to the base; and f. a second rocker adjustment means located adjacent the front of said base and aligned with the second pair of resilient receiving means and second seat cushion assembly such that the second rocker adjustment means can be positioned to adjust the amount of rocking arc obtainable by the second seat cushion assembly, where the second rocker adjustment means further comprises a generally rectangular shaped block which is hingeably attached to the base such that the rocker adjustment means can be aligned in three separate positions, a first position wherein one side of the rocker adjustment means lies against the upper surface of the base, a second position wherein the rocker adjustment means lies parallel to and in the same plane as the base, and a third position wherein the rocker adjustment means is supported generally perpendicular to the base by a second rocker support means slidably affixed to the base;

g. whereby each seat cushion assembly can be independently rocked back and forth from the front of the base to the rear of the base and can be individually adjusted to the desired amount of rocking, and the rocking on the base is cushioned by the first and second spacer members.

6. A seat in accordance with claim 5 wherein said base is made of plastic and the seat is portable.

7. A seat in accordance with claim 5 wherein said first and second spacer members are made of foam.

8. A seat in accordance with claim 5 wherein each seat rocking means is a metal rod and each of said resilient receiving means is made of resilient metal which permits the seat rocking means to be inserted into the transverse opening in the resilient receiving means and permits the seat rocking means to move in the transverse opening toward the base when a force is exerted on a seat cushion assembly to push it toward the base.

* * * * *